United States Patent [19]

Lindberg et al.

[11] Patent Number: 4,825,930

[45] Date of Patent: May 2, 1989

[54] HINGE ARRANGEMENT

[76] Inventors: Björn Lindberg, Bastugatan 46, 117 25 Stockholm; Christer Zarelius, Grev Magnigatan 8, 114 55 Stockholm, both of Sweden

[21] Appl. No.: 98,188

[22] Filed: Sep. 18, 1987

[30] Foreign Application Priority Data

Sep. 18, 1986 [SE] Sweden ..... 8603935

[51] Int. Cl.[4] ..... A47G 5/00

[52] U.S. Cl. ..... 160/135; 160/351; 403/53; 403/62

[58] Field of Search ..... 160/135, 351; 16/232, 16/224, 379; 403/53, 62

[56] References Cited

U.S. PATENT DOCUMENTS 4,147,198 4/1979 Ytter ..... 160/135
4,443,911 4/1984 Bannister ..... 160/135 X
4,448,231 5/1984 Salkeld et al. ..... 160/135

FOREIGN PATENT DOCUMENTS 0163455 12/1985 European Pat. Off. .
7217 3/1902 United Kingdom ..... 160/135

*Primary Examiner*—Blair M. Johnson
*Attorney, Agent, or Firm*—Burns, Doane, Swecker & Mathis

[57] ABSTRACT

The present invention relates to a hinge arrangement for hinging and coupling a first element (1) to a second element (2), of which elements at least one includes an internal cavity (1*a*) adjacent the hinge location (3) and a hinge member (4) which functions as a pivot pin or pivot arm and also holds the elements together. The elements (1) provided with cavities (1*a*) have formed therein one or more slots (5) which are oriented at right angles to the rotational axis (6) of the pivot arm or pin. The hinge member (4) is intended for insertion through respective slot for retention in the cavity (1*a*). The hinge member (4*a*) is retained in its respective slot through the agency of a bearing and guide surface provided on the member and intended for co-action with a corresponding bearing and guide surface provided in the cavity (1*a*) in the immediate vicinity of the slot (5).

23 Claims, 4 Drawing Sheets

FIG 5
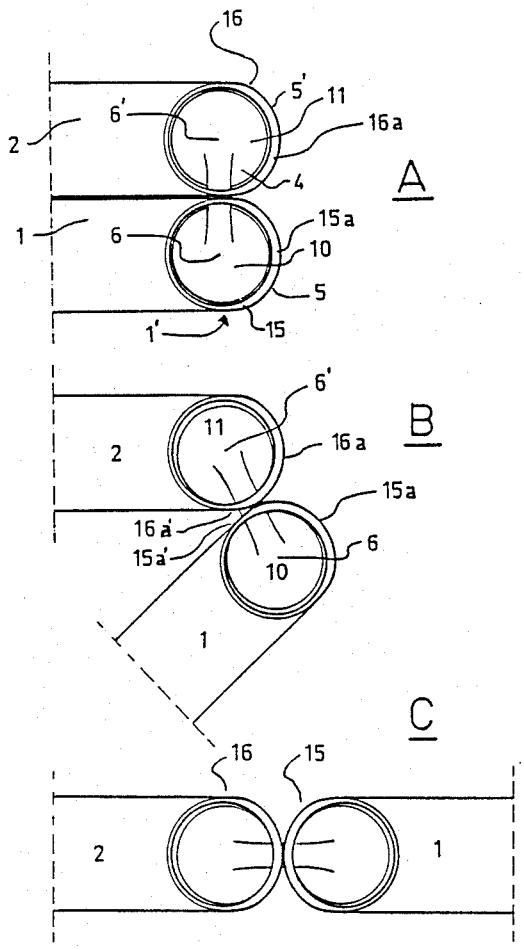
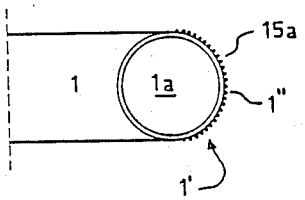
FIG 6
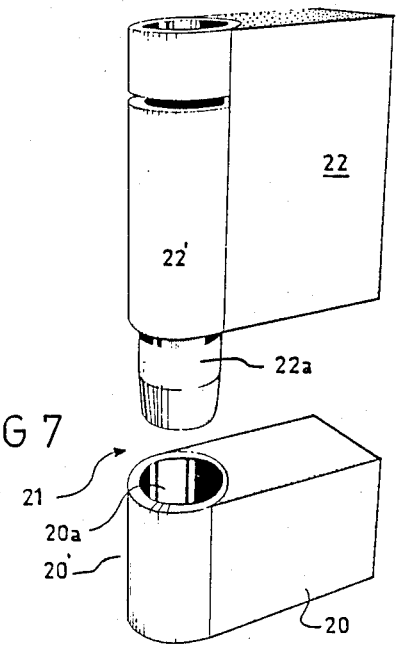
FIG 7

HINGE ARRANGEMENT

TECHNICAL FIELD

The present invention relates to a hinge arrangement for pivotally connecting a first element to a second element. More specifically, the invention relates to a hinge arrangement of the kind which, in order to function, requires at least one of the elements to present an internal cavity adjacent the hinge point this cavityb eing intended to co-act with a hinge member, such as a hinge pin or hinge arm, intended for holding the elements together.

Such a hinge arrangement can be used in various technical fields. The hinge arrangement according to the present invention, however, has been developed primarily for use with panel display systems or display assemblies, where a need is found for a simple hinge arrangement and a simple panel coupling which will enable panels to be connected together in a ready and simple fashion and then swung through 360° relative to one another.

The hinge arrangement or panel coupling can be used, with particular advantage, between two or more flat sheet-like elements which are connected together or to some other element, such as a wall or door frame.

The present invention also relates to a portable panel display system or sign system which incorporates the inventive hinge arrangement and which comprises a multiple of panels placed in edge-to-edge relationship, each of which panels is preferably embraced, either fully or partially, with a number of edge strips, wherewith at least two mutually adjacent edge strips of respective panels or sheet-like elements are hinged together by means of one or more of said hinge arrangements.

In the case of portable panel systems of this kind it is normal to use flat rectangular panels.

BACKGROUND PRIOR ART

A hinge arrangement effective in securing a first element to a second element, of which at least one element has an internal cavity located adjacent the hinge point, and which elements are hingedly held together by means of a hinge member, such as a hinge pin or hinge arm, is known to the art from European Patent Application Nos. 85303439.5, and 0163455.

A hinge arrangement of this published application comprises a channelled, extruded aluminium section, wherein a first channel is intended to embrace one edge of a panel and a second channel is intended to co-act with an extruded nylon section, which functions as a connected or coupling member, such as a hinge pin.

The hinge member is of elongated shape, having a circular part at each end thereof, which together with a pin is intended to coact with the channel in said extruded aluminium sections.

The hinge arrangement described in the aforesaid European Application will only allow a relative movement of 180° between the two hinge elements.

Hinge arrangements which allow relative movements through 360° are also known to the art, however. An example of one such hinge arrangement is found in European Patent Application No. 8236224.5, publication No. 0109466.

To this end, the mutually opposing surfaces of the first and second elements are provided with mutually corresponding serrations which are constantly in contact with one another as the two elements are swung. The two elements are held together at the mutually facing edge parts thereof by means of a stirrup-like device which is provided with bearing surfaces.

Various kinds of portable panel display or sign systems are known to the art. One example of such systems is described and illustrated in U.S. Pat. No. 4,147,198. This system comprises a eight hinged panels which can be folded, in concertina fashion, so that all panels will lie one against the other, and can be extended from this position to form a continuous wall structure.

Portable sign or display systems are also known for displaying so-called "blow-ups" which comprise extremely large enlargements of a photograph and which cannot be shown in their entirety on a single panel.

In this latter application, measures have been taken to reduce that part of the picture or image that is covered by the joint between two mutually adjacent panels, arranged edge-to-edge, and associated hinges.

SUMMARY OF THE INVENTION

TECHNICAL PROBLEMS

With reference to the present state of this art as described above, it is obvious that a qualified technical problem resides in the creation of conditions which will enable, through the agency of simple means, the maximum angle through which the hinge arrangement can swing to be adjusted in a manner which will allow pivotal movement afforded by the hinge arrangement to be effected through 360°, if so desired.

Another technical problem is one of providing a hinge arrangement which may includes solely one, separate member capable of being fitted readily to an edge part of a panel and which will provide an effective function in coaction with the panel, without needing to use specially designed tools.

A further technical problem resides in the provision of a simple hinge arrangement, particularly when intended for use with a panel display system, which has solely one single, separate member, and in which the part or parts of the hinge arrangement intended for co-action with said separate hinge member are integrated with the edging of a respective panel.

A further technical problem is one of providing a complete hinge arrangement comprising a sole separate part at low costs.

Another technical problem is one of providing a hinge arrangement with which the risk of pinching ones fingers, etc., between the hinge members or panel edges is substantially eliminated.

A further technical problem will be seen to exist in the provision of a simple hinge arrangement which can be applied readily to portable panel display systems or sign systems, exhibition panels, sound shields in open plan office systems, and to panels for children's playpens and also within the toy industry.

Another technical problem exists in the provision of a simple hinge arrangement having but a single separate member or loose member, which is intended to connect a first element hingedly to a second element and which also functions as a pivot pin or pivot arm between said elements, and which can be readily inserted through a narrow slot and into an internal cavity located in at least one of said elements.

A further technical problem is one of providing the separate, loose hinge member with bearing and guide surfaces which will enable the member to function as a pivot pin or pivot arm in its inserted position.

It will be seen that a further technical problem resides in reaching a configuration with regard to the separate hinge member which will enable said member to be readily produced in a punching tool or in a plastic moulding tool. In this regard the hinge member shall have an increasing thickness and/or an outward deviation in the intended direction of insertion, such as to enable the hinge member to be inserted through a narrow slot and co-act with the cavity in the first and/or second element through the agency of a snap-action.

When taking the aforesaid technical problems into account it will be seen that a further technical problem resides in the provision of hinge conditions such that when the first and second elements are swung to a first position (close together) the separate hinge member can be readily inserted through said slots into co-action with said elements, and when the elements are swung to a second position (edge-to-edge) a tension force will act on the hinge member so as to secure the hinge member more firmly in respective cavities of the elements and therewith improve the tension force acting between the elements in said edge-to-edge position thereof.

A further technical problem resides in the provsion of a simple hinge arrangement which will allow the first element to swing relative to the second element through an angle of at least 90° and at most 360°, and with which a desired angle of swing can be readily established in combination with the possibility of increasing the desired angle of swing with the aid of simple means.

In the case of portable display systems in particular, it is proposed in accordance with the invention that the first element and/or the second element has the form of a panel which has a hollow tubular member provided along at least one edge surface thereof, or on two mutually opposite edge surfaces thereof, these tubular members having narrow slots formed therein and forming part of the inventive hinge arrangement.

When considering the state of the prior art as described above it will be seen that a technical problem resides in the provision of a portable display system, or sign system, which comprises a multiple of panels placed in edge-to-edge relationship, and in which each of the panels is surrounded by a number of edge parts, of which at least two mutually adjacent edge parts of respective panels are hingedly connected by means of one or more hinge arrangements, and in which system provisions are found to minimizing coverage of the edge surfaces of the panel without detracting from the possibility of folding the panels together.

With reference to the known state of the art it will be seen that a further technical problem resides in the provision of display panel hinge arrangement which can be readily fitted or mounted and which have a form such that a panel holding device will be practically hidden from view in its operative position.

It will also be seen that in the case of hinged display systems a technical problem resides in providing conditions which will enable the first and second elements to comprise sheet-like elements each intended to carry part of a complete picture or image where a number of elements that are hinged together at mutually opposing, parallel edge surfaces to form a chain of elements which are interconnected by means of said inventive hinge arrangements can be extended to form a straight line or collapsed into a bundle or stack, with respective elements lying against one another, and where the coupling of said elements and the insertion of the separate hinge member can be effected in a simple manner.

A technical problem will also be seen to exist in the provision of means which will enable a first bundle or stack of elements or panels to be connected to a second bundle or stack of elements or panels in a manner such that mutually adjacent panels of respective bundles or stacks can be extended simultaneously.

When considering the circumstances discussed above and the description of the proposed hinge arrangement, it will be seen that a further technical problem resides in the provision of a display system that comprises a portable, flexible panels light in weight, where each panel may well comprise a framework, a plate-like element folded or bent at its edges, or at least two mutually parallel tubes to which a flat sheet can readily be applied.

Another technical problem resides in the provision of a display system in which the panels can be transported separately while collapsed (in concertina fashion) and fastened together with the aid of hinge arrangements, so as to enable them to be quickly extended to form a wall structure.

Another technical problem is one of providing such a display system in which a single panel, carrying a message, sign, or part of a photograph, can be readily exchanged irrespective of its position among a multiple of panels forming a wall structure in said system.

A further technical problem is one of providing a system of hinged panels intended for use in open office plans as dividing walls or acoustic shields which can be readily folded, moved and stored.

It will also be seen that a technical problem resides in providing, with the aid of simple means, a system comprising a multiple of mutually hinged panels which can be coupled together to form a children's playpen or like enclosure.

In the case of a display system it will be seen that a further technical problem resides in the provision of a panel to which at least one, preferably two mutually opposing edge sections of a frame structure can be firmly secured and with which the hinge function is integrated in said edge section or sections.

A further technical problem is one of providing a panel or element which can be fitted with an edge strip in the form of a hollow tubular member which can be readily provided with narrow slots, e.g. one slot in the upper part of the tubular member and one slot in the lower part thereof, and which can be held to an adjacent similar panel or element with the aid of a separate, loose thin plate which can be locked firmly in a respective slot and which is movable in the plane of rotation in said locked position.

A further technical problem is one of enabling panels that are placed one above the other in a vertical direction to be readily coupled together. In this regard, when the panels are fitted together with tubular side strips, a hinge pin can be placed in the open end of one side strip and then inserted into the open end of an overlying side strip, or vice versa.

SOLUTION

The present invention relates primarily to a hinge arrangement for pivotably holding a first element to a second element, of which elements at least one incorporates an internal cavity adjacent the hinge location, and comprising a hinge member which serves as a pivot pin or pivot arm and is operative in coupling said elements one to the other.

It is proposed in accordance with the invention that the element or elements incorporating said cavity has or have formed therein one or more slots which are oriented at right angles to the rotational axis of the hinge; that said hinge member is intended for insertion through said slot for retention in the cavity; that the hinge member is retained in said slot through the agency of a bearing and guide surface provided on the member and intended for coaction with a corresponding bearing and guide surface provided in the cavity or cavities in the immediate vicinity of said slot.

In the case of a portable display system, in which each of said elements incorporates a cavity and is provided with corresponding slots, it is proposed that the hinge member consists of a separate device or member having two rearwardly extending and mutually facing bearing and guide surfaces seen in a suitable direction of insertion.

When seen in the direction of insertion, the hinge member conveniently has an increasing thickness and/or an outward deviation from a plane located in and extending parallel with the direction of insertion and said slot.

According to one advantageous embodiment of the invention, the mutually facing surfaces of said two elements are eccentric in relation to said rotational axis.

Preferably, the slots and said hinge member are mutually constructed in a manner to enable one hinged element to rotate through an angle of 90°, in the case of a display system preferably 180°, and at maximum 360° in relation to another hinged element.

According to another advantageous embodiment of the invention the hinge member comprises two flat circular, or part circular parts which are joined together by an interconnecting arm, and the hinge member is constructed to be brought into co-action with said elements by means of a snap-action.

Preferably the first element and/or the second element comprises a sheet-member which has a tubular element located along one edge part thereof.

The rear bearing and guide surface on the hinge member may have the form of tabs punched from said member, or the member may be slotted and the tongues or tabs folded out therefrom. Alternatively, the bearing and guide surface may comprise a bead or an undulating surface formed on the hinge member. When the hinge arrangement is intended for use in a portable panel display system in particular the breadth or extension of respective slots extends beyond the centre of a circular cavity corresponding to at least half of the width of the connecting arm, thereby to obtain a pivot angle of 360°.

According to another advantageous embodiment of the invention, one of said elements has provided along one edge surface thereof a hollow tubular member, the wall thickness of which increases towards the side of said wall that faces away from said element, and the hinge member is constructed to take up the tension forces contingent on the greater wall thickness.

One or both of the mutually facing surfaces of the first and second elements may be treated to enhance the frictional forces generated thereby.

The surfaces may also be knurled or serrated and arranged to co-act with one another.

It also lies within the scope of the invention to provide a particularly suitable portable display system incorporating a multiple of hinge arrangements, in which system the first and the second elements each comprise a panel which is intended to carry part of a complete picture or a message. It is particularly proposed that a multiple of panels are provided with hinge arrangements along mutually opposite, parallel edge surfaces thereof, to form a continuous series of panels held together by said hinge arrangements and capable of being extended in a straight line or collapsed into bundle form, with respective panels lying against one another.

Finally, it is proposed that a multiple of panels collapsed to form a first bundle can be secured by attachment means to a multiple of panels collapsed to form a second bundle such that the panels of both bundles can be extended simultaneously. In principle, three parts or several bundles can be extended simultaneously.

ADVANTAGES

Those advantages primarily afforded by a hinge arrangement constructed in accordance with the present invention reside in the provision of the possibility of obtaining, in the case of a portable display system, a hinge arrangement which will only encroach on the visible surface of the panel to a very slight extent, in combination with the fact that the hinge arrangement can also be used for other purposes. A further advantage is afforded by the fact that with the inventive hinge arrangement incorporating a slot, only one single separate hinge member, functioning as a pivot pin or pivot arm, is required, this member serving the dual purpose of coupling the first element to the second element and permitting relative rotating therebetween.

The primary characteristic features of a hinge arrangement according to the present invention are set forth in the characterizing clause of the following claim 1, while the primary characteristic features of a portable display system incorporating the inventive hinge arrangement are set forth in the characterizing clause of the following claim 15.

BRIEF DESCRIPTION OF THE DRAWINGS

A preferred embodiment of an inventive hinge arrangement and its application to a display system will now be described in more detail with reference to the accompanying drawings, in which.

Figure 8:
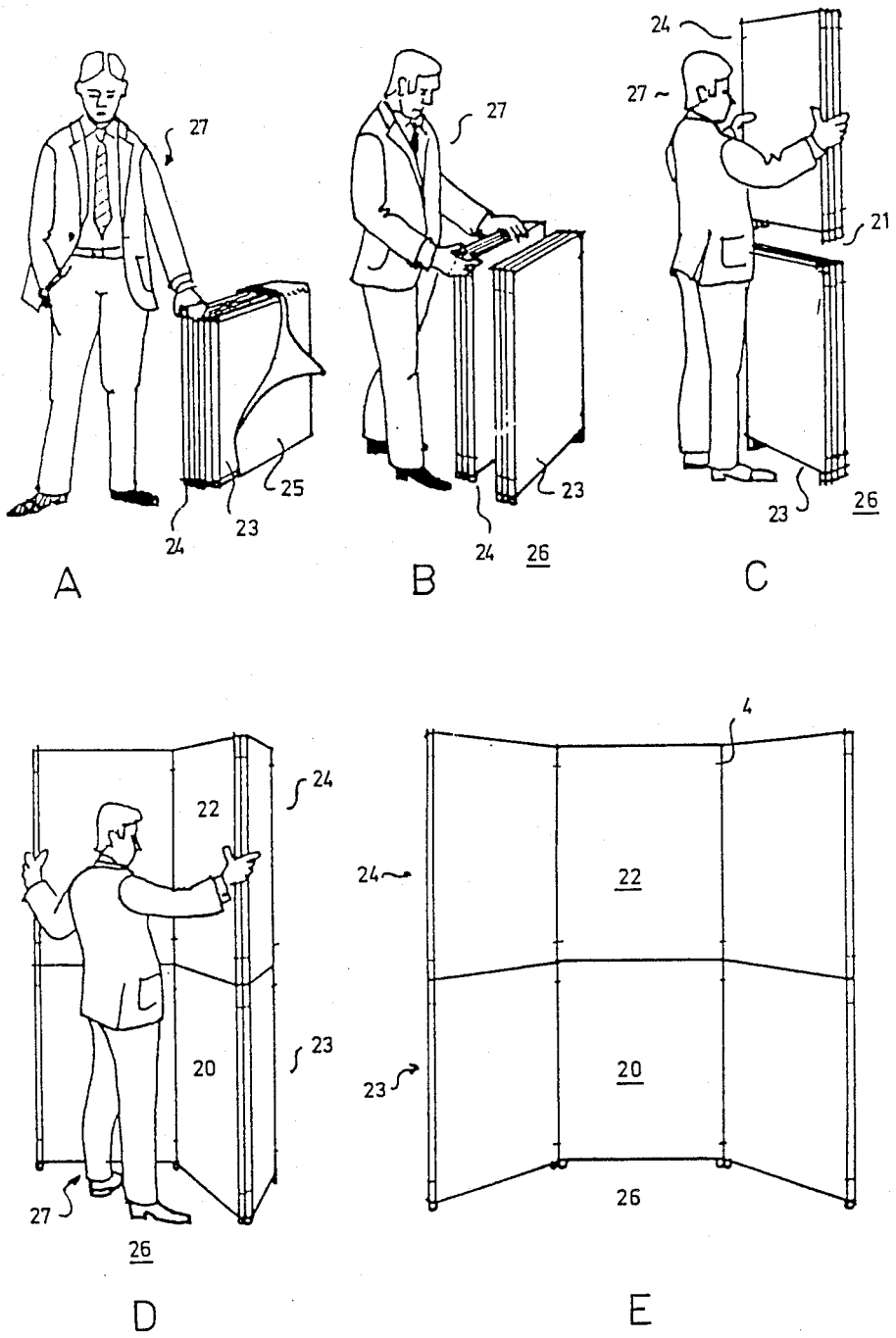
Figure 9:
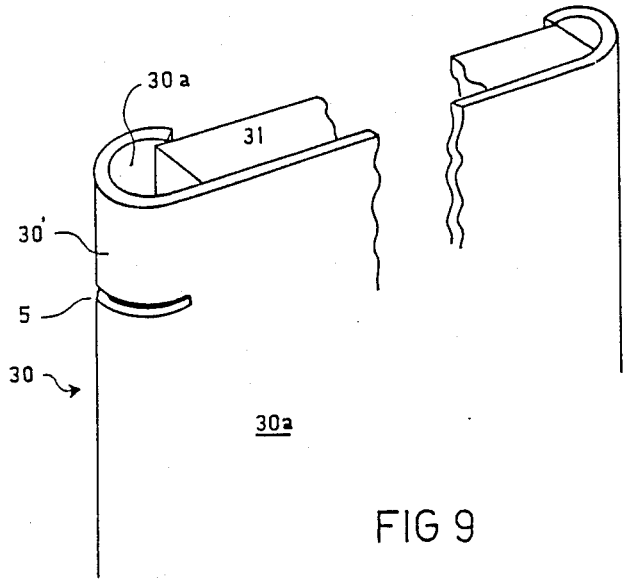

FIG. **4*a*** is an enlarged view of a second embodiment of a hinge member which couples the element together and serves as a hinge pin;

FIG. **4*b*** is an enlarged view of a third embodiment of a hinge member which couples the elements together and serves as a hinge pin;

FIG. 5 illustrates schematically the edge portion of two mutually adjacent panels of a display system when it is desired to secure the first element to the second element with the elements closed with respect to one another as shown in A, partially open with respect to each other as shown in B and, in an edge to edge position as shown in C;

FIG. 6 illustrates an embodiment with which rotation of the first element in relation to the second element is guided without relative sliding of the elements;

FIG. 7 illustrates in perspective the possibility of creating in portable display systems conditions whereby a plurality of panels collapsed to form a first package can be caused to co-act, via means herefor, with a plurality of panels collapsed to form a second package, although in which Figure only one panel of the first package is shown in co-action with a panel of the second package for the sake of simplicity;

FIGS. 8 A–E illustrates various sequences when opening out a portable display system comprising six panels with the use of a number of hinge arrangements according to the present invention; and FIG. 9 illustrates an alternative embodiment of a suitable panel for a portable display system.

DESCRIPTION OF EMBODIMENTS AT PRESENT PREFERRED

Figure 1:
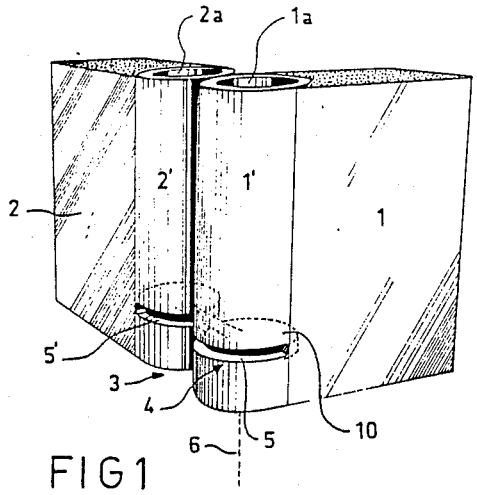
FIG. 1 is a perspective view of a first element hinged to a second element by means of a hinge arrangement according to the invention, the elements being held together by a hinge member which also functions as a pivot pin.

FIG. 1 illustrates in perspective and partially in section a hinge assembly constructed in accordance with the invention and with which a first element can be hinged to a second element, where the first element 1 has the form of a first panel having an edge strip 1' mounted thereon, and the second element 2 has the form of a second panel 2 with an edge part 2' mounted thereon.

It should be noted here that the inventive principles can also be applied to good effect when, for example, the second element 2 comprises a stationary wall section, belonging to a cupboard or the like.

It is essential to the present invention, however, that at least one of the elements for instance the element 1, has an internal cavity 1*a* located within the edge part 1', and in all events adjacent a hinge location 3. The hinge arrangement includes a hinge member 4 which couples the element 1 to the element 2 and functions as a hinge pin or hinge arm.

The hinge part 1' of the element 1 having cavity 1*a* formed therein is provided with a plurality of mutually parallel slots, normally at least two slots, although in FIG. 1 only one slot, 5, has been shown for the sake of clarity, this slot 5 being formed at right angles to an axis of rotation 6 which extends through the centre of the circular cavity 1*a* and a member serving as a pivot or hinge pin 10. The illustrated hinge member 4 has a flat configuration and is intended to be inserted through the slot 5, preferably in the manner and in the direction illustrated in FIG. 2, and is intended to be secured in the cavity 1*a* of the edge part 1'. To this end, the hinge member 4 has formed thereon a rearwardly located bearing and guide surface, referenced 4*a* and 4*b* in FIGS. 2 and 4, as seen in the insertion direction. Naturally, the hinge member can be inserted in a different manner, as illustrated in FIG. 5.

The bearing and guide surfaces 4*a*, 4*b* are intended to be brought into co-action with complementary bearing and guide surfaces formed in the interior of the cavity 1*a*, adjacent said slot 5, i.e. on the inner surface of the edge strip 1' as illustrated by reference 7 in FIG. 2.

Figure 2:
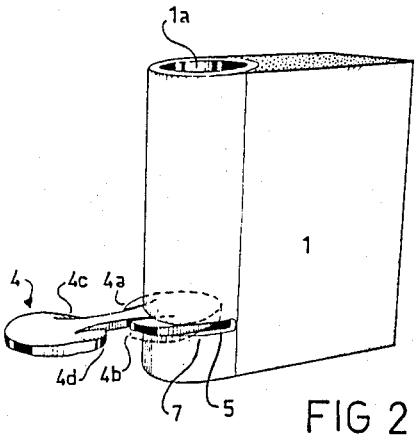
FIG. 2 illustrates the insertion of the hinge member into the first element, in a suitable insertion direction.

Preferably, the edge parts 1' and 2' of both elements 1 and 2 are provided with cavities 1*a*, 2*a*, and each of said edge parts is provided with corresponding slots 5, 5', in which case the hinge member 4 will comprise a separate member having two rearwardly located bearing and guide surfaces as seen in the suitable insertion direction illustrated in FIG. 2. Thus, FIG. 2 not only illustrates the pair of bearing and guide surfaces 4*a* and 4*b*, but also the pair of bearing and guide surfaces 4*c* and 4*d*.

Figure 4:
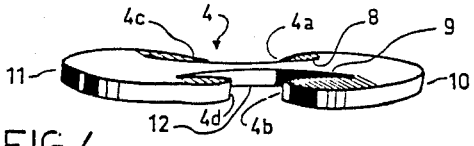
FIG. 4 is an enlarged view of a first embodiment of a hinge member which couples the elements together and which serves as a hinge pin.
Figure 4B:
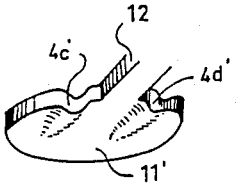
Figure 4A:
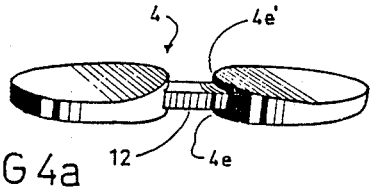

As will be seen more clearly from the enlarged view in FIGS. 4, 4*a* and 4*b*, the hinge member presents, in said insertion direction, an increasing thickness and/or an outward deviation from a plane located in or parallel with the insertion direction and said slot.

Figure 3:
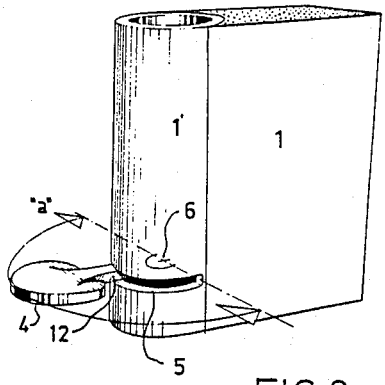
FIG. 3 shows how the inserted hinge member forms a pivot pin, and also illustrates the conditions enabling the hinge member to rotate about its axis of rotation when in coaction with the first element.

In the FIG. 4 embodiment the bearing and guide surfaces 4*a* and 4*b* on the hinge member 4 have the form of outward deviations formed by slots 8, 9 located adjacent said guide surfaces 4*a* and 4*b*, these slots enabling the guide surfaces 4*a* and 4*b* to take the position illustrated in FIG. 3, although said parts can also be bent in towards a plane so that they can be pressed in through the slot 5.

In the embodiment of FIG. 4*b* the bearing surfaces, here referenced 4*c*' and 4*d*', on the hinge member 4 have the form of undulating surfaces.

As illustrated in FIG. 4*a*, the thickness of the hinge member 4 is increased in order to form said rearwardly located bearing and guide surfaces 4*e* and 4*e*', which are located symmetrically with the centre plane of the hinge member.

FIG. 3 illustrates how the hinge member 4, e.g. the hinge member illustrated in FIG. 4, can be inserted through the slot 5 and thereby form a pivot or hinge pin rotatable about an axis 6. It will be understood that the circumferential extension of the slot 5 in the illustrated tubular strip 1' will determine the angle "a" through which the hinge member 4 can rotate relative to said edge strip. In the FIG. 3 embodiment the extremities of the slot 5 lie slightly beyond the centre or diameter line, of the cavity 1*a*, thereby enabling the hinge member 4 to rotate through an angle of 180°.

When the hinge arrangement is to be used to hingedly connect two panels of a portable display system, the slot 5 and the hinge member 4 are formed to allow the first panel to be swung in relation to the other panel through an angle of at least 180°, more suitable through an angle of 360°, i.e. twice the angle "a" illustrated in FIG. 3.

It will be noted that in the case of a 360° angle, half of the angle of rotation can be allotted to one panel and half to the other panel in relation to the hinge or pivot pin, although other conditions may also apply in dependence on the form of the slot or the slots.

The hinge member 4 of the embodiments illustrated in FIGS. 4 and 4*a* has the form of two circular, or part circular, flat discs 10, 11 connected together by an arm 12. FIG. 4*b* shows only the one disc part, referenced 11'.

The mutually opposing bearing and guide surfaces 4*a*, 4*b* or 4*c*, 4*d* of the two disc parts 10 and 11 enable the hinge member 4 to co-act with the edge part 1' of the panel 1, through the slot 5, with the aid of a snap-action.

In the FIG. 4 embodiment, the rearwardly located bearing and guide surface is formed by diverging slots 8, 9 and the resultant tabs are folded outwardly from a plane common to the remainder of the hinge member, to an extent such as to plastically deform certain regions within the disc parts 10 and 11.

In the FIG. 4*a* embodiment, the rearwardly located bearing and guide surfaces 4*e*, 4*e*' have the form of a bead located on the hinge member adjacent the connecting arm 12.

As illustrated in FIG. 3, the length extension of the slot 5 is such as to extend beyond the centre 6 of the circular cavity 1*a* through a distance corresponding exactly to half the width of the connecting arm 12, such that the angle of rotation is precisely 360°.

In the embodiment illustrated in FIG. 5 one edge part 1' of the panel 1 has the form of a tubular member 15, the wall thickness of which increases on the side 15*a* facing away from the panel 1, and the hinge member 4 is slightly resilient and adapted, inter alia, via the connecting arm 12, to take-up the tension forces occurring during rotation and contingent on the greater wall thickness. The panel 2 is provided with a corresponding tubular member 16, the wall section 16*a* of which has a corresponding increasing thickness.

In the position illustrated in FIG. 5*a*, with two panels 1 and 2 located adjacent one another, the hinge member 4 can be inserted into corresponding slots 5, 5', one in each panel 1 and 2, without creating a tension force between the disc parts 10 and 11, through the connecting arm 12. The hinge member may be inserted into respective slots in a direction parallel with the centre plane of the panels.

FIG. 5*b* illustrates a position in which one panel 1 has been swung in relation to the other panel 2. As will be seen from this Figure, as the panel is swung further in relation to the other panel, the thickness of the tubular member is such that the distance bretween the disc parts 10 and 11 of the hinge member, or the rotational centres 6 and 6' thereof will increase, therewith resulting in a compressing force between the panels 1 and 2 and, preferably, an extension of the connecting arm 12 or inward pressing of the bearing surfaces.

Larger forces can be expected to occur in the connecting arm 12 of the embodiment shown in FIGS. 4*a* and 4*b* than in the embodiment shown in FIG. 4.

It may be particularly suitable to provide at sections 15*a'* and 16*a'* (FIG. 5*b*) a wall thickness which imparts to the surface parts 15*a* and 16*a* a circular line which results in the same force action on the hinge member 4, irrespective of the prevailing position of rotation between the panels 1 and 2.

FIG. 5*c* illustrates the position in which this compressing force has reached its maximum; this force can be considered to be constant during rotation of the panels until said panels are in a straight line with one another. Although it may be suitable to provide a tubular member having the cross-sectional shape illustrated in FIG. 5, it is also possible to mount on a tubular member of uniform wall thickness a collar such as to provide a tube having the cross-sectional shape of FIG. 5.

Furthermore, as illustrated in FIG. 6, the surface 1'' of the first panel 1 facing the other panel 2, and/or vice versa, may be provided with a coating or treated in some other way so that said surface exhibits a greater coefficient of friction, thereby to prevent relative movement between the panel surfaces, such movement possibly resulting in tilting of one panel relative to the other.

In the embodiment of FIG. 6 the friction-enhancing surface 1'' has the form of a serrated surface, with the serrations of mutually opposite edge parts 1', 2' being arranged to co-act with one another so as to prevent one panel being positioned obliquely in relation to the other.

The invention also relates to a portable display system which can advantageously utilize a multiple of hinge arrangements of the aforedescribed kind.

With such display systems it is proposed that the first panel 1 and the second panel 2 are each intended to carry part of a complete picture, image or message. In this case, the hinge arrangement will encroach on the full picture or message only to a slight extent.

It is particularly proposed that a plurality of panels are provided with edge parts which enable said hinge arrangements to co-act with mutually opposite, parallel edge surfaces, thereby to form a continuous series of panels which are coupled together by a plurality of such hinge arrangements and which can be extended into a straight line or collapsed to form a bundle with respective panels lying against adjacent panels in a zig-zag configuration.

FIG. 7 illustrates how a number of lower panels folded to form a first bundle or package can be connected to a similar number of upper panels folded to form a second bundle or package, with the aid of a coupling arrangement 21 comprising a hole 20*a* in the edge part 20' of the lower panel, here referenced 20, and a pin 22*a* located in the edge part 22' of the upper panel, here referenced 22, such as to enable the panels to be extended simultaneously, two-by-two from each package or bundle, only one upper and one lower panel 22, 20 being shown for the sake of simplicity.

This coupling arrangement will naturaly enable three or more panel packages to be placed one upon the other and extended as a unit.

This is illustrated in more detail in FIG. 8, which illustrates the possibility of packing two panels packages 23 and 24, each comprising three panels, into a case or bag 25. When wishing to assemble the panel arrangement, the panel packages 23 and 24 are removed from the bag 25 and the package 23 containing the lower panels, is placed on the floor or like support surface 26, while the package 24, containing the upper panels, is placed on the package 23 such that the pins or pegs 22*a* in the lower part of the upper panel package pass into the holes 20*a* provided in the upper part of the lower panel package 23.

The panels are then extended in "concertina fashion" by the attendant 27.

The hinge member 4 is then inserted at selected locations, such that mutually adjacent horizontally extending panels are pivotally hinged together.

FIG. 9 is a greatly simplified illustration of a panel 30 which comprises a planar carrying surface 30*a* having at least one edge surface 30', preferably two oppositely located edge surfaces and conceivably also three or more edge surfaces, provided with a curved section to form a cavity 30*a*. The edge surface 30', and also other edge surfaces has one or more slots 5 formed therein, which together with the hinge member 4 constitute a hinge arrangement in accordance with the invention, as described in the aforegoing.

A sheet of material 31 can be mounted to one side of the carrier surface 30*a* and held firmly in said curved section.

It will be understood that the invention is not restricted to the aforedescribed and illustrated embodiments, and that modifications can be carried out within the scope of the following claims.

For example, the invention is not restricted to panels of the illustrated configuration, but can also be applied with triangular, pentagonal panels etc. This affords the possibility of creating three-dimensional constructions.

We claim:

1. A hinge arrangement for hinging and coupling a first element to a second element for pivoting about a rotational axis, comprising:

an internal cavity adjacent a hinge location disposed on at least one of said elements;

said internal cavity being defined by a curved interior wall portion;

a hinge member which serves as a pivot at said rotational axis and holds said elements together;

at least one elongate slot in said curved interior wall portion defined by two opposing wall portions formed in said at least one element, said slot is oriented at right angles to the rotational axis of said pivot;

said hinge member having at least one portion insertable through said slot between said two opposing wall portions for retention of said member in the cavity;

at least one curved bearing and guide surface, disposed on said hinge member and forming part of the portion of said member insertable into said slot;

at least one curved bearing and guide surface on said curved interior wall portion, said wall portion being adjacent said slot;

said retention of said member in said cavity is caused by the curved bearing and guide surface of said curved interior wall portion coacting with said at least one curved bearing and guide surface disposed on said hinge member.

2. A hinge arrangement according to claim 1, each of said elements having an internal cavity and at least one slot, in each curved internal wall portion said hinge member being a separate entity and having two curved bearing and guide surfaces.

3. A hinge arrangement according to claim 1, said hinge member having an increasing thickness along the direction of insertion and said slot.

4. A hinge arrangement according to claim 1, said first and second elements having mutually facing surfaces which are eccentric in relation to said rotational axis of said pivot.

5. A hinge arrangement according to claim 1, the slots and said hinge member being constructed in a manner to enable one hinged element to rotate through an angle of at least 90° and preferably about 360° in relation to the other hinged element.

6. A hinge arrangement according to claim 2, said hinge member comprising two flat parts which are joined together by a connecting arm, said parts being at least partially circular.

7. A hinge arrangement according to claim 1, said hinge member being constructed in a manner which enables it to be held in respective hinged elements through a snap-action.

8. A hinge arrangement according to claim 1, at least one of said first and second elements comprising a sheet-like member which has a tubular element located along one edge surface thereof.

9. A hinge arrangement according to claim 1, said at least one bearing and guide surfaces disposed on said hinge member having the form of tabs punched from said member.

10. A hinge arrangement according to claim 1, said at least one bearing and guide surfaces disposed on said hinge member comprising an undulating surface formed thereon.

11. A hinge arrangement according to claim 1, the extension of respective slots enabling said hinge member to swing therein through an angle of 180°.

12. A hinge arrangement according to claim 4, one of said first and second elements having disposed along one edge surface thereof, a hollow tubular member,the wall thickness of which increases towards the side of said wall that faces away from said element; said hinge member being constructed to take-up the tension forces created as a result of said increasing wall thickness as the connected elements are swung relative to one another.

13. A hinge arrangement according to claim 4, at least one of mutually facing surfaces of said first and second elements having friction-enhancing means provided thereon.

14. A hinge arrangement according to claim 4, at least one of mutually facing surfaces of said first and second elements having knurled or serrated surfaces which co-act with one another.

15. A panel display assembly which utilizes a multiple of hinge arrangements according to claim 1, each of said first and second elements being the edge portion of a plurality of panels respectively, at least one of said plurality of panels carrying part of a complete picture or image.

16. A panel display system according to claim 15, the plurality of panels being hingedly connected by a number of said hinge arrangements to form a hinged panel assembly, the plurality of panels extendable to form a straight row of panels and foldable one upon the other to form a collected stack or bundle with the plane of one panel lying closely adjacent the plane of a next panel.

17. A panel display system according to claim 15, having attachment means for connecting mutually hinged panels folded to form a bundle of panels to a similar bundle of folded, mutually hinged panels so as to enable the panels forming said bundles to be opened out simultaneously.

18. A hinge arrangement according to claim 2, said hinge member having an increasing thickness along the direction of insertion and said slot.

19. A hinge arrangement according to claim 6, the extension of respective slots enabling the connecting arm of said hinge member to swing therein through an angle of 180°, i.e the extremities of said slots lie beyond the centre of the internal cavity in respective first and second elements.

20. A hinge arrangement according to claim 13, at least one of mutually facing surfaces of said first and second elements having knurled or serrated surfaces which co-act with one another.

21. A panel display system according to claim 16, having attachment means for connecting mutually hinged panels folded to form a bundle of panels to a similar bundle of folded, mutually hinged panels so as to enable the panels forming said bundles to be opened out simultaneously.

22. A hinge arrangement according to claim 1, said hinge member having surfaces which deviate outwardly from a plane located in and extending parallel with the direction of insertion in said slot.

23. A hinge arrangement according to claim 2, said hinge member having surfaces which deviate outwardly from a plane located in and extending parallel with the direction of insertion in said slot.

* * * * *